US005128585A

United States Patent [19]

Ragland, Jr.

[11] Patent Number: 5,128,585

[45] Date of Patent: Jul. 7, 1992

[54] COLOR PICTURE TUBE HAVING IMPROVED CORNER SUPPORT FOR A SHADOW MASK-FRAME ASSEMBLY

[75] Inventor: Frank R. Ragland, Jr., Lancaster, Pa.

[73] Assignee: Thomson Consumer Electronics, Inc., Indianapolis, Ind.

[21] Appl. No.: 494,363

[22] Filed: Mar. 16, 1990

[51] Int. Cl.[5] ..... H01J 29/80; H01J 29/81; H01J 29/82

[52] U.S. Cl. ..... 313/406; 313/402; 313/404

[58] Field of Search ..... 313/402, 406, 404, 405, 313/407

[56] References Cited

U.S. PATENT DOCUMENTS

| | | | |
|---|---|---|---|
| 3,529,199 | 9/1970 | Duistermaat et al. | 313/85 |
| 4,317,064 | 2/1982 | Dougherty | 313/406 |
| 4,723,088 | 2/1988 | Sone et al. | 313/404 |
| 4,728,853 | 3/1988 | Sone et al. | 313/406 |
| 4,755,713 | 7/1988 | Wagenknecht | 313/406 |
| 4,827,180 | 5/1989 | Sone et al. | 313/404 |
| 4,886,997 | 12/1989 | Iuoue et al. | 313/407 |
| 5,021,707 | 6/1991 | Bauder | 313/402 |

FOREIGN PATENT DOCUMENTS

| | | | |
|---|---|---|---|
| 0319229 | 12/1989 | Japan | 313/402 |

*Primary Examiner*—Donald J. Yusko
*Assistant Examiner*—Nimeshkumar D. Patel
*Attorney, Agent, or Firm*—Joseph S. Tripoli; Dennis H. Irlbeck

[57] ABSTRACT

The improved color picture tube includes an evacuated glass envelope having a rectangular faceplate panel with two long sides and two short sides. The panel includes a major axis paralleling the two long sides, a minor axis paralleling the two short sides and two diagonals that extend between opposing corners of the panel. The panel includes a shadow mask assembly mounted therein by support means that are located at the corners of the panel. The support means at each of the spaced positions includes a stud attached to the glass envelope and a spring having an aperture therein engaging the stud. The improvement comprises the studs being located slightly off of the diagonals of the panel between the diagonals and the major axis.

4 Claims, 2 Drawing Sheets

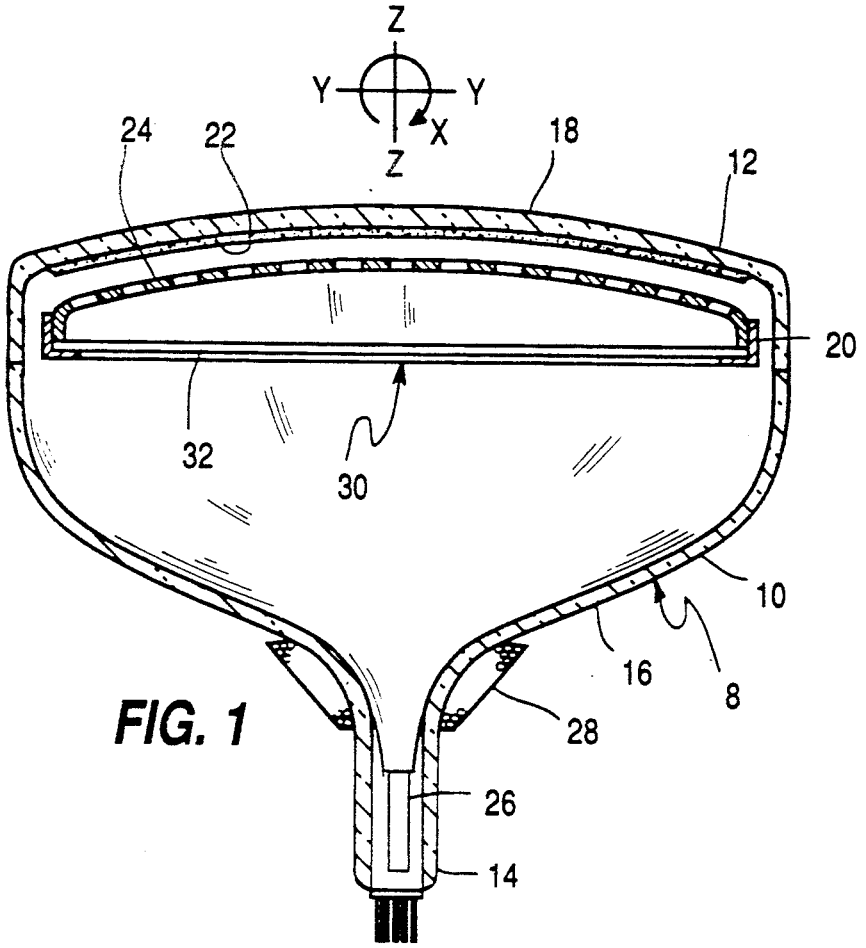
FIG. 1
FIG. 2
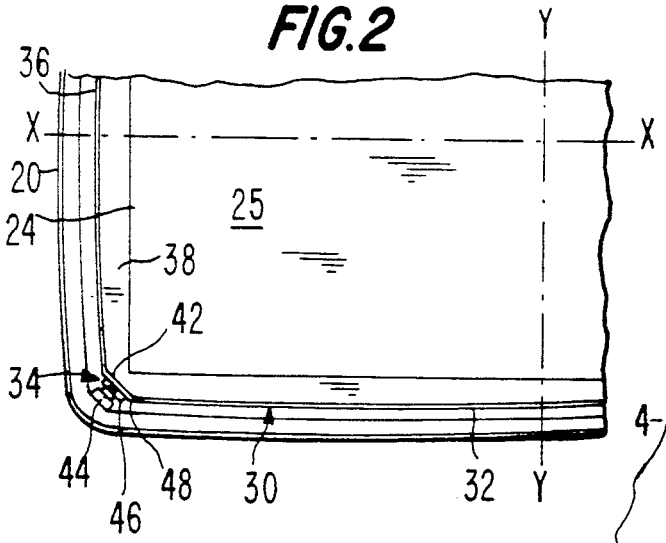
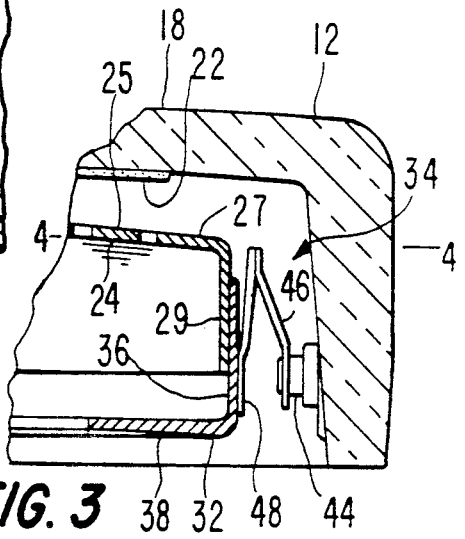
FIG. 3

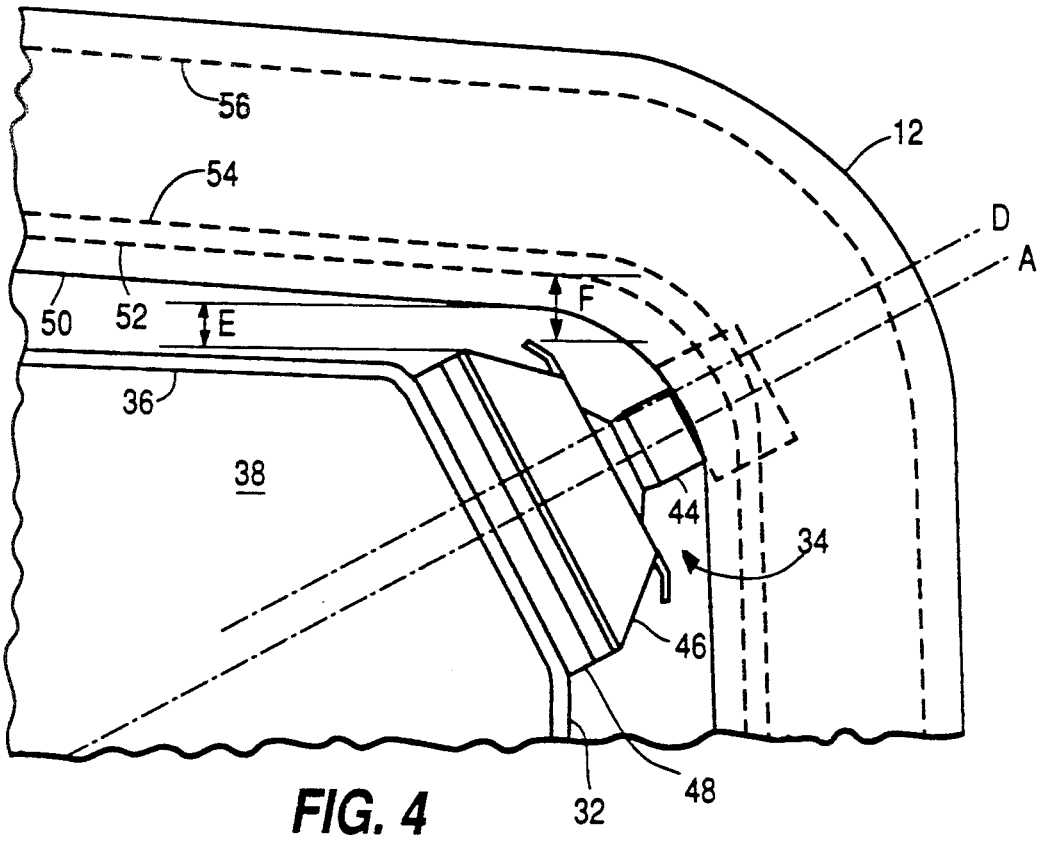
FIG. 4
FIG. 5
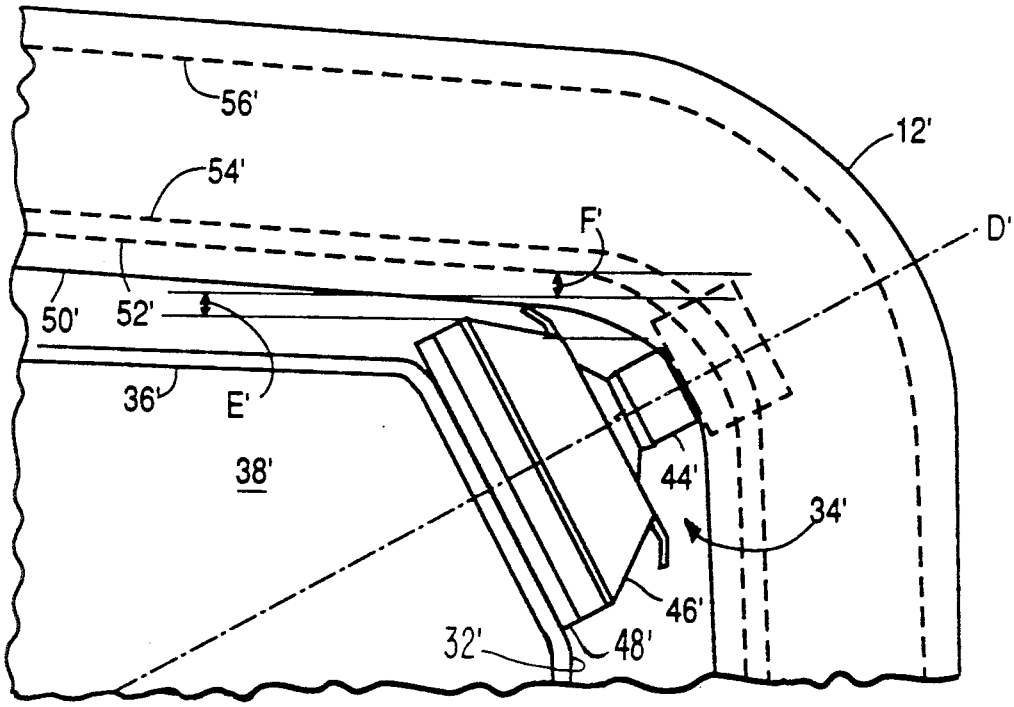

COLOR PICTURE TUBE HAVING IMPROVED CORNER SUPPORT FOR A SHADOW MASK-FRAME ASSEMBLY

This invention relates to color picture tubes of the type having a shadow mask attached to a peripheral frame which is suspended in relation to a cathodoluminescent screen and, particularly, to improved means for suspending a mask-frame assembly at the corners of a faceplate panel in such a tube.

BACKGROUND OF THE INVENTION

In most current color picture tube types, a peripheral frame supporting a shadow mask is suspended in a faceplate panel by means of springs that are welded either directly to the frame or to plates which in turn are welded to the frame. In the directly welded version, the springs are usually made of bimetallic materials; and in the plate version, the plates are bimetallic. As the springs or plates become heated by transfer of heat from the mask through the frame, the bimetallic materials expand differently, thereby bending the springs or plates to cause movement of the mask-frame assembly toward a screen disposed on the panel.

It is common to use either three or four springs to support a mask-frame assembly within a rectangular faceplate panel of a tube. In a three-spring support system, one spring is usually located at the upper center of the mask, and the other two springs are located along the sides of the tube between the centers of the sides of the mask and the lower two corners of the mask. In a four-spring support system, springs are usually located at the top and bottom centers of the mask and at the left and right centers of the mask. In both the three- and four-spring support systems, as described above, it is possible for the mask-frame assembly to twist slightly and shift relative to the faceplate, during tube manufacture and/or operation.

A known means for minimizing twisting and shifting of a mask-frame assembly uses spring supports at the four corners of the frame. Embodiments for achieving such corner support are shown in U.S. Pat. No. 4,723,088, issued to Sone et al. on Feb. 2, 1988, and in U.S. Pat. No. 4,728,853, issued to Sone et al. on Mar. 1, 1988.

A problem encountered using corner mask supports in a tube having a 16×9 aspect ratio is that there is insufficient room for the mask supports in the corners to permit proper insertion and removal of the mask. This problem occurs because of the decreased angle (29.36°) the tube diagonal makes with the tube major axis in a 16×9 aspect ratio tube, as compared to the corresponding angle (36.87°) in a 4×3 aspect ratio tube. When the corners of a mask frame are angled perpendicularly to the diagonal in a 16×9 aspect ratio tube, the clearance between the mask support and the long side of the tube faceplate becomes very small. Therefore, it is desirable to modify the mask support means to provide additional clearance in a tube, preferably a 16×9 aspect ratio tube, between the mask support and the long side of a tube faceplate panel skirt.

SUMMARY OF THE INVENTION

The improved color picture tube includes an evacuated glass envelope having a rectangular faceplate panel with two long sides and two short sides. The panel includes a major axis paralleling the two long sides, a minor axis paralleling the two short sides and two diagonals that extend between the opposing corners of the panel. The panel includes a shadow mask assembly mounted therein by support means that are located at the corners of the panel. The support means at each of the spaced positions includes a stud attached to the glass envelope and a spring having an aperture therein engaging the stud. The improvement comprises the studs being located slightly off of the diagonals of the panel between the diagonals and the major axis.

BRIEF DESCRIPTION OF THE DRAWINGS

FIG. 1 is an axially sectioned side view of a color picture tube embodying the present invention.

FIG. 2 is a bottom view of a quadrant of the faceplate panel and mask-frame assembly of the tube of FIG. 1.

FIG. 3 is a partial sectional view of a corner of the faceplate panel and mask-frame assembly of FIG. 2.

FIG. 4 is a partial sectional top view of a corner of the faceplate panel and mask-frame assembly, with a stud and mask support means offset from a tube diagonal and the shadow mask removed, taken at line 4—4 of FIG. 3.

FIG. 5 is a partial sectional top view of a corner of the faceplate panel and mask-frame, with a stud and mask support means aligned with a tube diagonal and the shadow mask removed.

DETAILED DESCRIPTION OF THE PREFERRED EMBODIMENTS

FIG. 1 shows a rectangular color picture tube 8 having a glass envelop 10, comprising a rectangular faceplate panel 12 and a tubular neck 14 connected by a rectangular funnel 16. The panel 12 comprises a viewing faceplate 18 and a peripheral flange or sidewall 20 which is sealed to the funnel 16. The faceplate panel 12 includes two orthogonal axes: a major axis X, parallel to its wider dimension (usually horizontal), and a minor axis Y, parallel to its narrower dimension (usually vertical). The major and minor axes are perpendicular to the central longitudinal axis Z of the tube which passes through the center of the neck 14 and the center of the panel 12. A mosaic three-color phosphor screen 22 is carried by the inner surface of the faceplate 18. The screen preferably is a line screen with the phosphor lines extending substantially parallel to the minor axis Y. Alternatively, the screen may be a dot screen. A multiapertured color selection electrode or shadow mask 24 is removably mounted, by improved means, in predetermined spaced relation to the screen 22. An electron gun 26 is centrally mounted within the neck 14, to generate and direct three electron beams along convergent paths through the mask 24 to the screen 22.

The tube of FIG. 1 is designed to be used with an external magnetic deflection yoke, such as the yoke 28, located in the vicinity of the funnel-to-neck junction. When activated, the yoke 28 subjects the three beams to magnetic fields which cause the beams to scan horizontally and vertically in a rectangular raster over the screen 22.

The shadow mask 24 is part of a mask-frame assembly 30 that also includes a peripheral frame 32. The mask-frame assembly 30 is shown positioned within the faceplate panel 12 in FIGS. 1, 2, 3 and 4. The mask-frame assembly 30 is mounted to the panel 12 by four improved support means 34, one of which is shown in each of FIGS. 2, 3 and 4.

The frame 32 includes two substantially perpendicular flanges, a first flange 36 and a second flange 38, in an L-shaped cross-sectional configuration. The first flange 36 extends from the second flange 38 in a direction toward the screen 22. The second flange 38 extends from the first flange 36 in a direction toward the central longitudinal axis Z of the tube 8. The four corners 42 of the frame 32 are truncated, being perpendicular to an axis A of the support means.

The shadow mask 24 includes a curved apertured portion 25, an imperforate border portion 27 surrounding the apertured portion 25, and a skirt portion 29 bent back from the border portion 27 and extending away from the screen 22. The mask 24 is telescoped within or set inside the frame 32 and welded to the inside surface of the first flange 36.

Mask-frame assembly support means 34 are included at each of the four corners of the frame and panel. Each support means 34 includes a stud 44, a spring 46 and a plate 48. Each stud 44 is a conically-shaped metal member that is attached to the panel sidewall 20. Each plate 48 is welded near one end to the flange 36 at a truncated corner of the frame 32. The spring 46 is attached at one of its ends to the other end of the plate 48. An aperture, near the free end of each spring 46, engages the conical portion of a stud 44.

FIG. 4 shows a top view of the mask frame 32 and support means 34, with the spring 46 in perspective, as viewed from the screen. For simplicity, cross-hatching of the glass panel and the shadow mask are omitted. A solid line 50 indicates the inner surface of the panel where the section is made, the section also being at the level of the top of the spring 46 and plate 48. A dashed line 52 is a contour line on the inner surface of the panel 12 at the level of the plane of the stud. Dashed lines 54 and 56 are the sealing edge of the panel 12. A line D indicates the true diagonal of the tube faceplate and a line A indicates the axis of the stud 44, spring 46 and plate 48. A diagonal D is a line that extends through the centers of the radii of curvature of the opposing corners of the panel and through the center of the panel. Generally, the panel diagonal D coincides with the diagonal of the viewing screen. As shown, the stud axis A is offset from the true diagonal of the tube in a direction toward the major axis X of the tube. In a tube having a 16×9 aspect ratio, the diagonal line D forms and angle of 29.36° with the major axis X. In an improved tube having a 34 inch (86 cm) viewable diagonal, the studs are offset approximately 3.00 mm vertically from the panel diagonal toward the major axis of the panel. The stud axis A forms an angle of 29.014° with the major axis X. Offsetting the stud 44 by 3.00 mm provides a clearance, designated E, between the near end of the spring 46 and the panel sidewall at line 50 and provides a clearance, designate F, between a tip of the far end of the spring 46 and the panel sidewall at line 52.

The improved embodiment of FIG. 4, having the offset stud, can be compared to a tube having no offset, as shown in FIG. 5. Parts in the tube of FIG. 5 that are similar to the parts in the improved embodiment of FIG. 4 are labelled with primes of the same numbers. FIG. 5 shows the tube having a clearance E′ between the near end of the spring 46′ and the panel sidewall at line 50′ and a clearance F′ between a tip of the far end of the spring 46′ and the panel sidewall at line 52′.

In the improved embodiment of FIG. 4, the spring 46 and plate 48 are made slightly wider to make them stronger than the spring 46′ and plate 48′, respectively, of the tube of FIG. 5. Even with the wider spring and plate, the clearances E and F of the improved embodiment are larger than the clearances E′ and F′ of the tube of FIG. 5. In tubes having a 16×9 aspect ratio and a viewing screen diagonal dimension of 34 inches (86 cm), the clearances E and F of the tube with the offset studs are 3.47 mm and 4.47 mm, respectively, and the clearances E′ and F′ of the tube without the offset are 1.59 mm and 2.16 mm, respectively, The additional clearances permit use of stronger springs as well as easier insertion and removal of the mask-frame assembly from the faceplate panel.

Although the present invention has been described with respect to a tube having a shadow mask attached to a peripheral frame, the invention may be applied to a tube in which peripheral reinforcement of a shadow mask is provided integrally with the mask, without use of a separate frame.

What is claimed is:

1. In a color picture tube including an evacuated glass envelope having a rectangular faceplate panel with two long sides and two short sides, said panel including a major axis paralleling said long sides, a minor axis paralleling said short sides and two diagonals extending between opposing corners of said panel, said panel including a shadow mask assembly mounted therein by support means located at the four corners of said panel, said support means providing compensation for thermal expansion of said shadow mask assembly, the thermal compensation being a movement of said shadow mask assembly toward a screen of said tube as the shadow mask assembly expands, said support means at each of said panel corners including a stud attached to said glass envelope, a spring having an aperture therein engaging said stud, and a plate welded between said spring and said shadow mask assembly, the improvement comprising said studs being slightly offset from said diagonals in a direction towards the major axis.

2. The tube as defined in claim 1, wherein said panel has a 16×9 aspect ratio.

3. The tube as defined in claim 2, wherein said diagonals of the panel each form an angle of 29.36° with the major axis, and the central longitudinal axes of the studs each form an angle of about 29.014° with the major axis.

4. The tube as defined in claim 2, wherein, when said panel has a 34 inch (86 cm) viewing diagonal dimension, the studs are offset approximately 3.00 mm vertically from the diagonal of the panel toward the major axis of the panel.

* * * * *